US006869566B1

(12) United States Patent
Kendig et al.

(10) Patent No.: US 6,869,566 B1
(45) Date of Patent: Mar. 22, 2005

(54) METHOD OF FABRICATING METALLIC GLASSES IN BULK FORMS

(75) Inventors: Kevin L. Kendig, Beavercreek, OH (US); Jonathan E. Spowart, Dayton, OH (US); Daniel B. Miracle, Bellbrook, OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 57 days.

(21) Appl. No.: 10/378,728

(22) Filed: Mar. 5, 2003

(51) Int. Cl.[7] ..... B22F 7/02

(52) U.S. Cl. ..... 419/8; 419/35; 419/64; 148/561

(58) Field of Search ..... 148/561; 419/8, 419/35, 64

(56) References Cited

U.S. PATENT DOCUMENTS 3,846,345 A * 11/1974 Mason et al. ..... 252/514
3,856,513 A 12/1974 Chen et al.
4,197,146 A 4/1980 Frischmann
4,594,104 A * 6/1986 Reybould ..... 75/243
5,498,393 A * 3/1996 Horimura et al. ..... 419/28
5,679,466 A * 10/1997 Noguchi et al. ..... 428/551
6,071,357 A * 6/2000 Guruswamy et al. ..... 148/301

OTHER PUBLICATIONS

Szuecs et al. *Mechanical Properties of* $Zr_{56.2}Ti_{13.8}Nb_{5.0}Cu_{6.9}Be_{12.5}$ *Ductile Phase Reinforced Bulk Metallic Glass Composite* Acta Material Inc. Elsevier Science Ltd. 2001.

* cited by examiner

*Primary Examiner*—George Wyszomierski
(74) *Attorney, Agent, or Firm*—AFMCLO/JAZ; Richard A. Lambert

(57) ABSTRACT

The method of the present invention incorporates an amorphous metal powder coated with a ductile crystalline metal or alloy. The coated powder is consolidated to form a dense compact of isolated or continuous amorphous metal particles within a continuous ductile metal network. This provides a material in bulk product form exhibiting improved fracture properties including ductility and fracture toughness.

6 Claims, 1 Drawing Sheet

METHOD OF FABRICATING METALLIC GLASSES IN BULK FORMS

RIGHTS OF THE GOVERNMENT

The invention described herein may be manufactured and used by or for the Government of the United States for all governmental purposes without the payment of any royalty.

BACKGROUND OF THE INVENTION

The present invention relates generally to metallic glasses and, more specifically, to a method of fabricating metallic glasses into bulk product forms.

Generally, glass is a solid material obtained from a liquid that does not crystallize during cooling. A glass is an amorphous solid, meaning that atoms comprising the material are randomly arranged as opposed to an atomically ordered, crystalline structure. The most common meaning associated with the word glass is the familiar, transparent material commonly used in a myriad applications in everyday life. That glass, formed mostly of silica, is an electrical insulator and non magnetic.

A new class of material, called metallic glasses, was discovered in the 1960s. Unlike conventional metals, metallic glasses have a noncrystalline or amorphous atomic structure. Metals, as a rule, crystallize readily upon cooling. It was discovered that a rapid quench of the liquid metal, in the order of a million degrees Celsius per second, allowed the solid metal to retain its liquid, amorphous state. Metallic glasses possess a number of desirable properties such as very high elastic limit, excellent magnetic behavior, extremely high yield strength and resistance to wear and corrosion. They are useful in many products ranging from motor components to golf clubs.

A significant downside to the more widespread use of metallic glasses is the difficulty in manufacturing them into bulk product forms. Generally, the exceedingly high quench rate of the prior art processing techniques is amenable only to very thin layers of material, of the order of much less than 1 mm. There have been developed only a few alloy compositions that do not require the above described high quench rate and that allow for the direct production of metallic glasses in bulk product forms (greater than 1 to 2 mm thick.) Again, the vast majority of known metallic glass alloy compositions require cooling rates in excess of $10^3$ K/s, so that the maximum material thickness that can be produced in the amorphous state is much smaller than 1 mm. While some investigators have resorted to a powder metallurgy approach, consolidation of atomized powders of these alloys poses a significant technical challenge due to the extremely high strength and low macroscopic ductility of amorphous alloys. These metallic glasses typically crystallize at temperatures below those used in conventional processing practice to outgas and consolidate metal powders, which would destroy the amorphous atomic structure and the unique properties provided by the amorphous atomic structure. Thus, consolidation of amorphous metal powders cannot be accomplished by standard techniques.

The intrinsically poor fracture properties of amorphous metals are also a serious issue. Tensile ductility for amorphous metals is typically near 0%. Thus, widespread use of amorphous metals in fracture-critical structural applications will not occur until the fracture properties are improved and the technical hurdles described above are solved.

A need exists therefore for an improved method of fabricating metallic glasses in bulk product forms as well as improved metallic glass microstructures resulting from the improved method.

SUMMARY OF THE INVENTION

Accordingly, it is a primary object of the present invention to provide an improved method of fabricating metallic glasses into bulk product form.

Another object of the present invention is to provide improved metallic glass microstructures in the bulk product form exhibiting enhanced material properties.

Yet another object of the present invention is to provide improved metallic glass microstructures exhibiting significant tensile elongation and good fracture properties in the bulk product form.

These and other objects of the invention will become apparent as the description of the representative embodiments proceeds.

In accordance with the foregoing principles and objects of the invention, a method of fabricating metallic glasses is described. The method provides an improved technique for fabricating amorphous alloys into a bulk product form exhibiting dramatically enhanced properties.

The method of the present invention incorporates an amorphous metal powder. Advantageously and according to an important aspect of the present invention, the amorphous metal powder grains are coated with a ductile crystalline metal or alloy. The amorphous powder thus coated is consolidated to form a dense compact of isolated amorphous metal particles within a continuous ductile, crystalline metal network. This provides an amorphous material in bulk product form exhibiting improved fracture properties including ductility and fracture toughness.

BRIEF DESCRIPTION OF THE DRAWING

The accompanying drawing incorporated in and forming a part of the specification, illustrates several aspects of the present invention and together with the description serves to explain the principles of the invention. In the drawing.

DETAILED DESCRIPTION OF THE INVENTION

Figure 1:
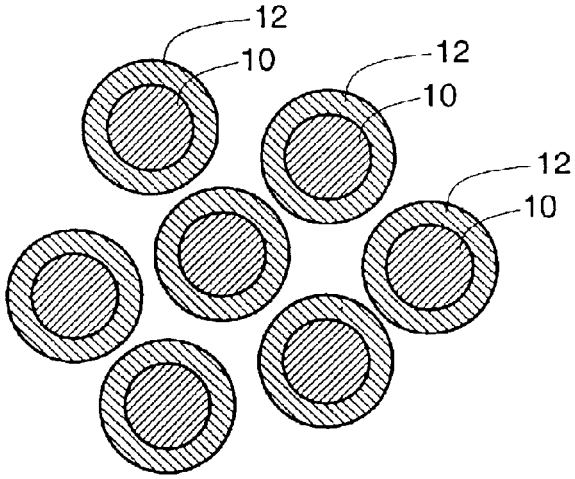
FIG. 1 is a diagrammatic illustration of several coated powder grains for use according to the method of the present invention.

Reference is made to FIG. 1 diagrammatically illustrating several coated amorphous powder grains for consolidation into a compact according to the method of the present invention. As will be described in more detail below, the compact made according to the method of the present invention advantageously combines the desirable properties of metallic glasses with those of ductile crystalline metals and alloys, enabling use in applications where tensile strength and toughness are important.

Metallic glasses are a relatively new class of materials. Unlike conventional crystalline metals, metallic glasses have a noncrystalline, amorphous structure, typically formed by an extraordinarily high quench rate to assure that the liquid metal does not crystallize during solidification. Amorphous metals and alloys exhibit many desirable qualities due to their noncrystalline makeup. For example strength up to 1560 MPa has been achieved in aluminum alloys, nearly three times higher than the best commercial, crystalline aluminum alloys. In copper based amorphous alloys, strengths in excess of 2000 MPa have been demonstrated. These desirable structural properties as well as others, such as improved corrosion resistance, are derived from the amorphous atomic structure.

A limitation on the more widespread use of metallic glasses lies in an inherent difficulty in manufacturing them in bulk product forms. Only a few compositions of metallic glasses exist that can be fabricated by casting into bulk product forms since the cooling rates needed to create the amorphous structure generally limit the casting thickness to less than 1 mm.

Figure 2A:
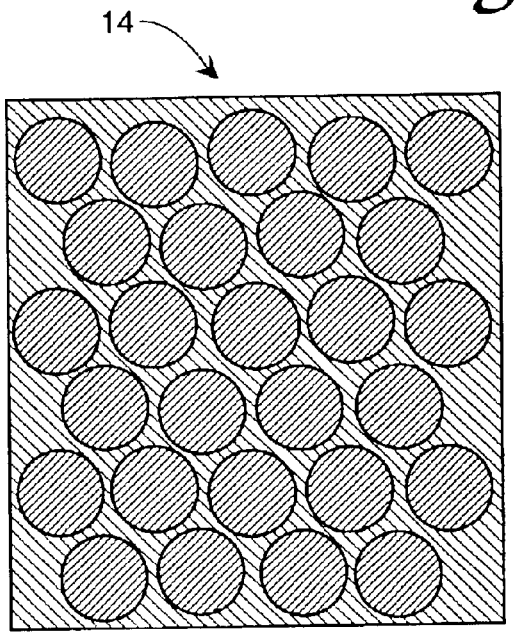
FIG. 2*a* is a diagrammatic cross sectional view of a bulk product form produced according to the method of the present invention; and, FIG. 2*b* is a diagrammatic cross sectional view of a bulk product form produced according to the method of the present invention wherein some deformation of the amorphous particles has taken place.
Figure 2B:
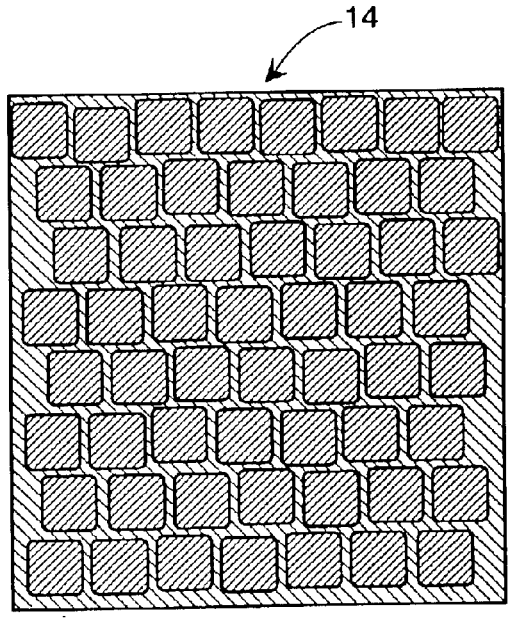

The method of the present invention advantageously overcomes the above limitations through the use of an amorphous metal powder. According to an important aspect of the present invention, the amorphous metal powder grains 10 are coated with a ductile crystalline metal or alloy 12. The powder grains thus coated are consolidated to form a dense compact 14 of isolated amorphous metal grains within a continuous ductile crystalline metal network, as shown in FIGS. 2*a* and 2*b*. Alternatively, the amorphous metal grains within the continuous metal network may also touch and thus be continuous. This provides an amorphous material in bulk product form exhibiting improved fracture properties including ductility and fracture toughness from the continuous ductile crystalline metal network and high strength from the amorphous metal grains. The bulk product thus formed would be useful in a wide variety of applications such as manufacture of structural components having high specific strength and good fracture properties, as well as the production of high thermal conductivity amorphous metal alloys such as for liquid rocket engine components where burn resistance and oxidation resistance are important.

The amorphous metal for use in the method of the present invention can be any metal or alloy that can be quenched into the amorphous state. Representative examples include, but are not limited to, zirconium, titanium, aluminum, nickel, copper, iron, tin, silver, gold and alloys thereof. The method of the present invention can be satisfactorily used with any amorphous metal alloy because it does not rely on the chemistry of the alloy to produce the desired result. The amorphous metal is produced by atomization, melt spinning or other appropriate techniques capable of producing amorphous metal product. The powder grains thus formed are in the range of less than 1.0 microns up to about 100 microns.

The amorphous metal powder grains are then coated with a ductile crystalline metal by electrochemical deposition, chemical vapor deposition, physical vapor deposition, sputtering or other suitable technique. The ductile crystalline metal would be chosen to provide significant uniform plasticity to the material. Representative choices of ductile metal include but are not limited to zirconium, aluminum, titanium, nickel, copper, iron, tin, silver, gold and alloys thereof.

The coated powder is next consolidated by any suitable technique such as direct powder forging, vacuum sintering, rolling, extrusion, pressing, magnetic compaction or other conventional techniques in the art of consolidation or any combination of these techniques at any temperature. Advantageously, the ductile crystalline coating eases the consolidation process over the consolidation of uncoated particles due to the deformation properties of the ductile crystalline metal coating itself.

Advantageously, a range of material structures is possible, according to the method of the present invention, depending on the mean size and size distribution of the amorphous metal powder, the specific amorphous metal powder utilized and the ductile crystalline metal coating selected, the relative thickness of the ductile crystalline metal coatings on the amorphous metal powders as well as the processing techniques employed. For example, and as shown diagrammatically in FIG. 2*a*, if the volume fraction of ductile crystalline metal coating in the final material is sufficiently high (above approximately 35% by volume) the shape of the amorphous particles is expected to be retained after consolidation, e.g., spherical particles will remain spherical, although the particle shape may not be retained for some combinations of materials used and consolidation techniques employed. If, on the other hand, and as shown diagrammatically in FIG. 2*b*, the volume fraction of ductile crystalline coating in the final material is sufficiently low (below approximately 35% by volume) complete consolidation will require some deformation of the amorphous powders. For the case of extremely low volume fractions of ductile crystalline metal coating, (not shown) the amorphous powders will be highly deformed and the ductile network will consist of very thin ligaments. In addition, depending on the properties of the amorphous material and crystalline metal coating and the technique used for consolidation, the amorphous phase may remain discontinuous or become continuous during consolidation.

In summary, numerous benefits have been described from utilizing the principles of the present invention. The method of fabricating metallic glasses in bulk product form of the present invention advantageously provides a metallic glass bulk product combining the desirable properties of metallic glasses with those of ductile metals and alloys, enabling use in wide variety of applications where tensile strength and toughness are important.

The foregoing description of the preferred embodiment has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the inventions in various embodiments and with various modifications as are suited to the particular scope of the invention as determined by the appended claims when interpreted in accordance with the breadth to which they are fairly, legally and equitably entitled.

We claim:

1. A method of fabricating metallic glasses in bulk product form comprising the steps of:

providing an amorphous metal powder;

coating said powder with a ductile crystalline metallic material;

consolidating said coated powder into a bulk product form by vacuum sintering.

2. A method of fabricating metallic glasses in bulk product form comprising the steps of:

providing an amorphous metal powder;

coating said powder with a ductile crystalline metallic material;

consolidating said coated powder into a bulk product form by rolling.

3. A method of fabricating metallic glasses in bulk product form comprising the steps of:

providing an amorphous metal powder;

coating said powder with a ductile crystalline metallic material by physical vapor deposition;

consolidating said coated powder into a bulk product form.

4. A method of fabricating metallic glasses in bulk product form comprising the steps of:

providing an amorphous metal powder;

coating said powder with a ductile crystalline metallic material by chemical vapor deposition;

consolidating said coated powder into a bulk product form.

5. A method of fabricating metallic glasses in bulk product form comprising the steps of:

providing an amorphous metal powder;

coating said powder with a ductile crystalline metallic material by electrochemical deposition;

consolidating said coated powder into a bulk product form.

6. A method of fabricating metallic glasses in bulk product form comprising the steps of:

providing an amorphous metal powder;

coating said powder with a ductile crystalline metallic material;

consolidating said coated powder into a bulk product form by magnetic compaction.

* * * * *